US011821286B2

(12) United States Patent
Ravensbergen et al.

(10) Patent No.: US 11,821,286 B2
(45) **Date of Patent: *Nov. 21, 2023**

(54) APPARATUSES, SYSTEMS AND METHODS FOR PRODUCING HYDROCARBON MATERIAL FROM A SUBTERRANEAN FORMATION

(71) Applicant: NCS MULTISTAGE INC., Calgary (CA)

(72) Inventors: John Ravensbergen, Calgary (CA); Lyle Laun, Calgary (CA); Michael Werries, Calgary (CA); Tim Johnson, Calgary (CA); Juan Montero, Calgary (CA); Brock Gillis, Calgary (CA)

(73) Assignee: NCS Multistage Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/873,781

(22) Filed: Jul. 26, 2022

(65) Prior Publication Data

US 2023/0018187 A1 Jan. 19, 2023

Related U.S. Application Data

(63) Continuation of application No. 16/491,981, filed as application No. PCT/CA2018/050261 on Mar. 6, 2018, now Pat. No. 11,434,735.

(Continued)

(51) Int. Cl.

| | |
|---|---|
| ***E21B 34/14*** | (2006.01) |
| ***E21B 43/12*** | (2006.01) |
| ***E21B 43/16*** | (2006.01) |

(52) U.S. Cl.
CPC ..... *E21B 34/14* (2013.01); *E21B 43/12* (2013.01); *E21B 43/16* (2013.01)

(58) Field of Classification Search
CPC ..... E21B 34/14; E21B 43/12; E21B 43/16
See application file for complete search history.

(56) References Cited

U.S. PATENT DOCUMENTS 3,306,365 A * 2/1967 Kammerer, Jr. ..... E21B 34/142 166/318
5,896,928 A 4/1999 Coon (Continued)

FOREIGN PATENT DOCUMENTS

WO WO 2018/032086 2/2018

OTHER PUBLICATIONS

International Search Report and Written Opinion for International (PCT) Patent Application No. PCT/CA2018/050261, dated May 17, 2018, 10 pages.

(Continued)

*Primary Examiner* — Matthew R Buck
(74) *Attorney, Agent, or Firm* — Sheridan Ross P.C.

(57) ABSTRACT

There is provided a flow control apparatus configured for integration within a wellbore string disposed within a wellbore extending into a subterranean formation and useable for effecting production of hydrocarbon material by providing flow communication for injection of treatment material for stimulating the reservoir and then receiving hydrocarbon material from the stimulated reservoir, and also for effecting production of hydrocarbon material by providing flow communication for injection of a displacement fluid for displacing hydrocarbon material to a second wellbore.

24 Claims, 13 Drawing Sheets

Related U.S. Application Data

(60) Provisional application No. 62/467,855, filed on Mar. 7, 2017.

(56) References Cited

U.S. PATENT DOCUMENTS

| | | | | |
|---|---|---|---|---|
| 6,220,357 | B1 | 4/2001 | Carmichael et al. | |
| 9,133,685 | B2 | 9/2015 | Fripp | |
| 9,644,461 | B2 * | 5/2017 | Castillo | E21B 43/12 |
| 9,816,348 | B2 * | 11/2017 | Asthana | E21B 43/12 |
| 10,900,324 | B2 * | 1/2021 | Grieco | E21B 43/14 |
| 11,434,735 | B2 * | 9/2022 | Ravensbergen | E21B 43/12 |
| 2009/0056952 | A1 * | 3/2009 | Churchill | E21B 34/14 166/373 |
| 2011/0083860 | A1 | 4/2011 | Gano et al. | |
| 2016/0215590 | A1 * | 7/2016 | Ravensbergen | E21B 34/12 |
| 2016/0265308 | A1 | 9/2016 | Arias et al. | |
| 2016/0273319 | A1 * | 9/2016 | Werries | E21B 43/08 |

OTHER PUBLICATIONS

Partial Supplementary European Search Report for Europe Patent Application No. 18764165.9, dated Dec. 1, 2020, 14 pages.
Extended European Search Report for Europe Patent Application No. 18764165.9, dated Mar. 10, 2021, 14 pages.

* cited by examiner

SECTION B-B

APPARATUSES, SYSTEMS AND METHODS FOR PRODUCING HYDROCARBON MATERIAL FROM A SUBTERRANEAN FORMATION

CROSS-REFERENCE TO RELATED APPLICATIONS

This application is a continuation of U.S. patent application Ser. No. 16/491,981, filed 6 Sep. 2019 and now issued as U.S. Pat. No. 11,434,735, which is a United States national-phase entry under 35 U.S.C. § 371 of Patent Cooperation Treaty Application PCT/CA2018/050261, filed 6 March 2018, which claims the benefit of priority of U.S. Provisional Patent Application 62/467,855, filed 7 Mar. 2017. The entirety of each of the above-referenced applications is incorporated herein by reference.

FIELD

The present relates to apparatuses, systems and methods for producing hydrocarbon material from a subterranean formation.

BACKGROUND

Over the life of a well, various well processes may be implemented via the well for producing hydrocarbon material from a subterranean formation. Current well completions are not sufficiently versatile to accommodate such different well processes.

SUMMARY

In one aspect, there is provided a flow control apparatus configured for integration within a wellbore string disposed within a wellbore extending into a subterranean formation, comprising: a housing includes a housing passage; a subterranean formation flow communicator extending through the housing for effecting flow communication between the subterranean formation and the passage; and a first flow control member displaceable relative to the subterranean formation flow communicator; and a second flow control member displaceable relative to the subterranean formation flow communicator; wherein: the first flow control member includes a first flow modulator configured for occluding the subterranean formation flow communicator with effect that the subterranean formation flow communicator is disposed in an occluded condition; and the second flow control member includes a second flow modulator configured for effecting a reduction in pressure of material that is flowing from the housing passage to the subterranean formation flow communicator.

In another aspect, there is provided a flow control apparatus configured for integration within a wellbore string disposed within a wellbore extending into a subterranean formation, comprising: a housing includes a housing passage; a subterranean formation flow communicator extending through the housing for effecting flow communication between the subterranean formation and the passage; and a flow controller configured for controlling conducting of material, via the subterranean formation flow communicator, between the passage and an environment external to the flow control apparatus; wherein: the flow controller is configured for disposition in at least first, second and third conditions; and the flow controller and the subterranean formation flow communicator are co-operatively configured such that: while the flow controller is disposed in the first condition, the flow controller is occluding the subterranean formation flow communicator such that the subterranean formation flow communicator is disposed in an occluded condition; while the flow controller is disposed in the second condition, the subterranean formation flow communicator is disposed in a non-occluded condition; and while the flow controller is disposed in the third condition, flow communication between the housing passage and the subterranean formation flow communicator is effected via a third condition-defined flow communicator, and the third condition-defined flow communicator includes a flow controller-defined flow conductor.

In another aspect, there is provided a flow control apparatus configured for integration within a wellbore string disposed within a wellbore extending into a subterranean formation, comprising: a housing includes a housing passage; a subterranean formation flow communicator extending through the housing for effecting flow communication between the subterranean formation and the passage; and a flow control member displaceable relative to the subterranean formation flow communicator; wherein: the flow control member includes a flow modulator for effecting a reduction in pressure of material that is flowing between the housing passage and the subterranean formation flow communicator; and the flow modulator includes a tortuous flow path-defining fluid conductor that defines a tortuous flow path.

In another aspect, there is provided a wellbore string, disposed within a wellbore, including a flow control apparatus comprising: a housing includes a housing passage; a subterranean formation flow communicator extending through the housing for effecting flow communication between the subterranean formation and the passage; and a flow controller configured for controlling conducting of material, via the subterranean formation flow communicator, between the passage and an environment external to the flow control apparatus; wherein: the flow controller is configured for disposition in at least first, second and third conditions; and the flow controller and the subterranean formation flow communicator are co-operatively configured such that: while the flow controller is disposed in the first condition, the flow controller is occluding the subterranean formation flow communicator such that the subterranean formation flow communicator is disposed in an occluded condition; while the flow controller is disposed in the second condition, flow communication between the housing passage and the subterranean formation flow communicator is effected via a second condition-defined flow communicator having a first resistance to material flow; while the flow controller is disposed in the third condition, flow communication between the housing passage and the subterranean formation flow communicator is effected via a third condition-defined flow communicator having a second resistance to material flow; and the second resistance to material flow is greater than the first resistance to material flow by a multiple of at least 50.

In another aspect, there is provided a process for producing hydrocarbon material from a subterranean formation, comprising: receiving hydrocarbon material within a first well from a the subterranean formation via subterranean formation flow communicator, and producing the received hydrocarbon material via the first well; after the producing of the hydrocarbon material via the first well, effecting disposition of a flow modulator relative to the subterranean formation flow communicator for effecting a reduction in pressure of material that is flowing within the first well, wherein the flow modulator includes a flow modulator-defined flow conductor; injecting displacement material into the subterranean formation via the subterranean formation flow communicator while the flow modulator is disposed relative to the subterranean formation flow communicator for effecting a reduction in pressure of material that is flowing within the first well, with effect that hydrocarbon material within the subterranean formation is displaced to a second well, wherein the injecting includes flowing the displacement material within the second well through the flow modulator-defined conductor; producing the hydrocarbon material that is received by the second well.

BRIEF DESCRIPTION OF DRAWINGS

The embodiments will now be described with reference to the following accompanying drawings, in which.

DETAILED DESCRIPTION

Figure 1:
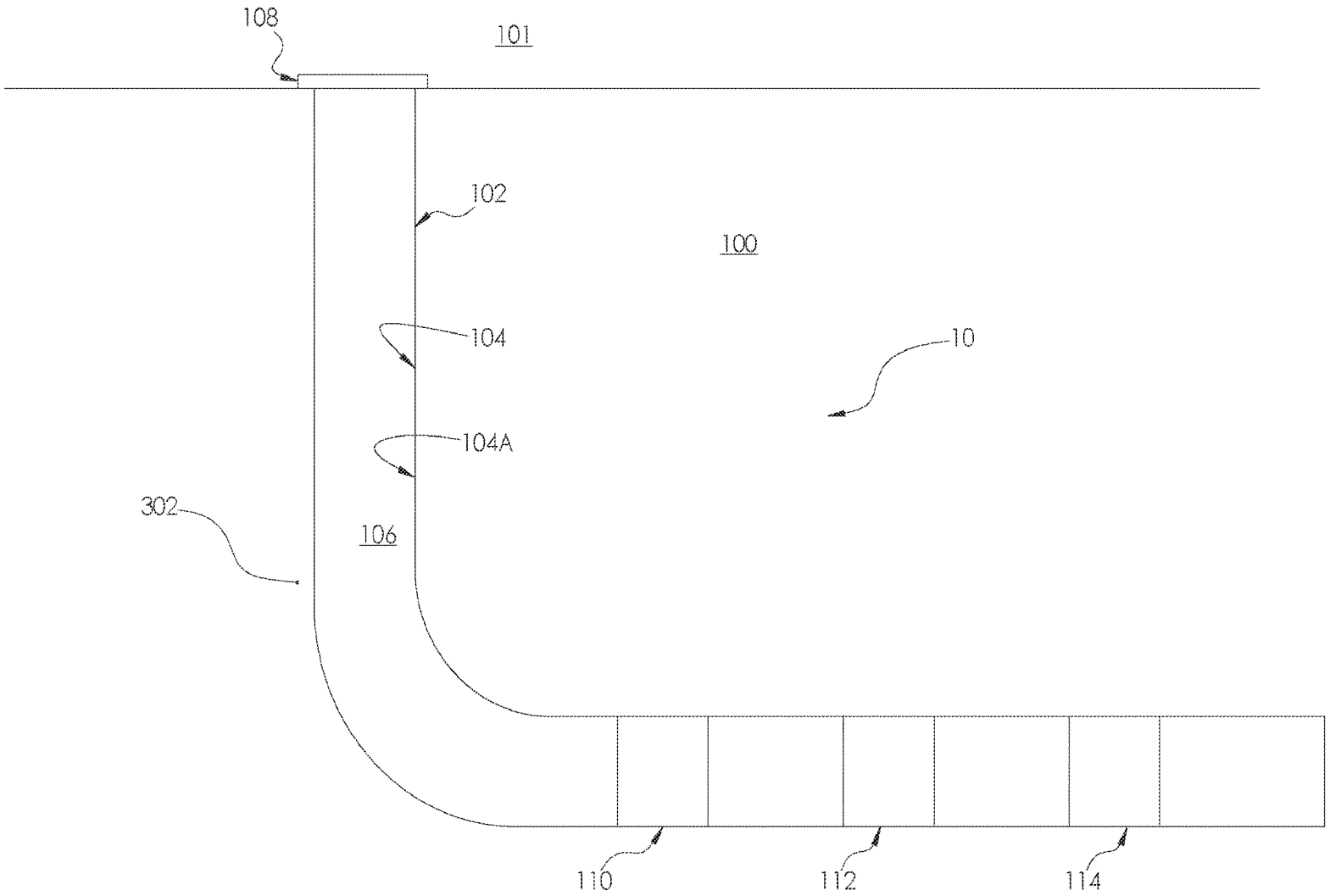
FIG. 1 is a schematic illustration of a system for effecting production of hydrocarbon material from a subterranean formation.

Referring to FIG. 1, there is provided a wellbore material transfer system 10 for conducting material from the surface 101 to a subterranean formation 100 via a wellbore 102 of a first well 302, from the subterranean formation 100 to the surface 10 via the wellbore 102, or between the surface 10 and the subterranean formation 100 via the wellbore 102. In some embodiments, for example, the subterranean formation 100 is a hydrocarbon material-containing reservoir.

The wellbore 102 can be straight, curved, or branched. The wellbore 102 can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

In one aspect, there is provided a process for stimulating hydrocarbon production from the subterranean formation 100. The process includes, amongst other things, conducting treatment material from the surface 10 to the subterranean formation 100 via the wellbore 102.

In some embodiments, for example, the conducting (such as, for example, by flowing) treatment material to the subterranean formation 100 via the wellbore 102 is for effecting selective stimulation of the subterranean formation 100, such as a subterranean formation 100 including a hydrocarbon material-containing reservoir. The stimulation is effected by supplying the treatment material to the subterranean formation 100. In some embodiments, for example, the treatment material includes a liquid, such as a liquid including water. In some embodiments, for example, the liquid includes water and chemical additives. In other embodiments, for example, the stimulation material is a slurry including water and solid particulate matter, such as proppant. In some embodiments, for example the treatment material includes chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the conducting of fluid, to and from the wellhead, is effected by a wellbore string 104. The wellbore string 104 may include pipe, casing, or liner, and may also include various forms of tubular segments. The wellbore string 104 includes a wellbore string passage 106.

In some embodiments, for example, the wellbore 102 includes a cased-hole completion, in which case, the wellbore string 104 includes a casing 104A.

A cased-hole completion involves running casing down into the wellbore 102 through the production zone. The casing 104A at least contributes to the stabilization of the subterranean formation 100 after the wellbore 102 has been completed, by at least contributing to the prevention of the collapse of the subterranean formation 100 that is defining the wellbore 102. In some embodiments, for example, the casing 104A includes one or more successively deployed concentric casing strings, each one of which is positioned within the wellbore 102, having one end extending from the well head 50. In this respect, the casing strings are typically run back up to the surface. In some embodiments, for example, each casing string includes a plurality of jointed segments of pipe. The jointed segments of pipe typically have threaded connections.

The annular region between the deployed casing 104A and the subterranean formation 100 may be filled with zonal isolation material for effecting zonal isolation. The zonal isolation material is disposed between the casing 104A and the subterranean formation 100 for the purpose of effecting isolation, or substantial isolation, of one or more zones of the subterranean formation from fluids disposed in another zone of the subterranean formation. Such fluids include formation fluid being produced from another zone of the subterranean formation 100 (in some embodiments, for example, such formation fluid being flowed through a production string disposed within and extending through the casing 104A to the surface), or injected stimulation material. In this respect, in some embodiments, for example, the zonal isolation material is provided for effecting sealing, or substantial sealing, of flow communication between one or more zones of the subterranean formation and one or more others zones of the subterranean formation via space between the casing 104A and the subterranean formation 100. By effecting the sealing, or substantial sealing, of such flow communication, isolation, or substantial isolation, of one or more zones of the subterranean formation 100, from another subterranean zone (such as a producing formation) via the is achieved. Such isolation or substantial isolation is desirable, for example, for mitigating contamination of a water table within the subterranean formation by the formation fluids (e.g. oil, gas, salt water, or combinations thereof) being produced, or the above-described injected fluids.

In some embodiments, for example, the zonal isolation material is disposed as a sheath within an annular region between the casing 104A and the subterranean formation 100. In some embodiments, for example, the zonal isolation material is bonded to both of the casing 104A and the subterranean formation 100. In some embodiments, for example, the zonal isolation material also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing 104A, and (d) at least contributes to the support of the casing 104A. The zonal isolation material is introduced to an annular region between the casing 104A and the subterranean formation 100 after the subject casing 104A has been run into the wellbore 102. In some embodiments, for example, the zonal isolation material includes cement.

For wells that are used for producing reservoir fluid, few of these actually produce through wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string is provided to conduct reservoir fluid, received within the wellbore, to the wellhead 108. In some embodiments, for example, the annular region between the last casing string and the production tubing string may be sealed at the bottom by a packer.

In some embodiments, for example, the conduction of fluids between the surface 10 and the subterranean formation 100 is effected via the passage 106 of the wellbore string 104.

In some embodiments, for example, the conducting of the treatment material to the subterranean formation 100 from the surface 10 via the wellbore 102, or of hydrocarbon material from the subterranean formation 100 to the surface 10 via the wellbore 102, is effected via one or more flow communication stations (three flow communication stations 110, 112, 114 are illustrated) that are disposed at the interface between the subterranean formation 100 and the wellbore 102. Successive flow communication stations 110, 112, 114 may be spaced from each other along the wellbore 102 such that each one of the flow communication stations 110, 112, 114, independently, is positioned adjacent a zone or interval of the subterranean formation 100 for effecting flow communication between the wellbore 102 and the zone (or interval).

For effecting the flow communication, each one of the flow communication stations 110, 112, 114 includes a subterranean formation subterranean formation flow communicator 210 through which the conducting of the material is effected. In some embodiments, for example, the subterranean formation flow communicator 210 is disposed within a sub that has been integrated within the wellbore string 104, and is pre-existing, in that the subterranean formation flow communicator 210 exists before the sub, along with the wellbore string 104, has been installed downhole within the wellbore 102.

Each one of the flow communication stations 110, 112, 114, independently, includes a flow control apparatus 200. The flow control apparatus 200 includes a housing 202. The housing 202 includes a housing passage 204. In some embodiments, for example, the housing 202 includes an uphole flow communicator 206 (such as, for example, a port) at an uphole end 200A of the apparatus 200, and a downhole flow communicator 210 (such as, for example a port) at a downhole end 200B of the apparatus 200, and the housing passage 204 extends between the uphole and downhole flow communicators 206, 208. The flow control apparatus 200 is configured for integration within the wellbore string 104 such that the wellbore string passage 106 includes the passage 204. The integration may be effected, for example, by way of threading or welding. In some embodiments, for example, the integration is by threaded coupling, and, in this respect, in some embodiments, for example, each one of the uphole and downhole ends 200A, 200B, independently, is configured for such threaded coupling to other portions of the wellbore string 104.

Figure 3:
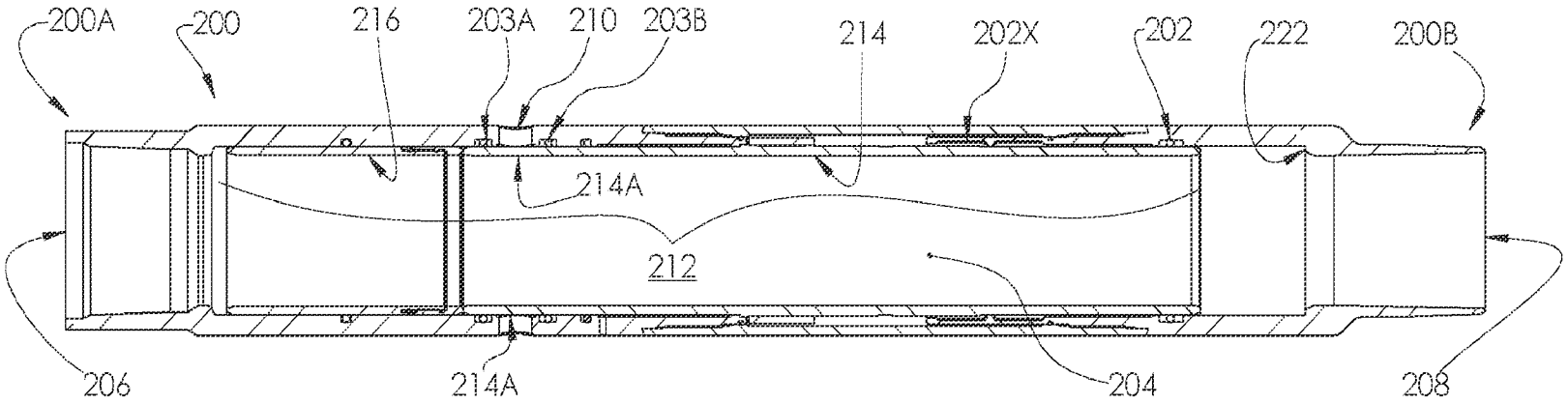
FIG. 3 is a sectional elevation view of the flow control apparatus of FIG. 2, taken along lines B-B, illustrating occlusion of the flow communicator by the first flow modulator of the first flow control member.
Figure 2:
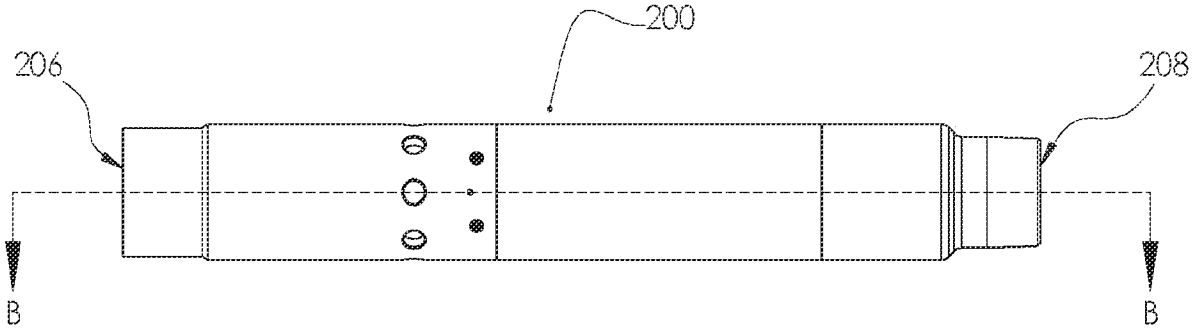
FIG. 2 is a front elevation view of a first embodiment of a flow control apparatus for use within the system illustrated in FIG. 1.

Referring to FIGS. 2 and 3, the flow control apparatus 200 includes a subterranean formation flow communicator 210 extending through the housing 202. In some embodiments, for example, the subterranean formation flow communicator 210 is in the form of one or more ports 210A. The flow control apparatus 200 further includes a flow controller 212 configured for controlling conducting of material (such as, for example, flow of material), via the subterranean formation flow communicator 210, between the passage 204 and an environment external to the flow control apparatus (e.g. such as, for example, the subterranean formation). In this respect, the flow controller 212 is configured for controlling the conducting of material (such as, for example, material flow) through the subterranean formation flow communicator 210.

In some embodiments, for example, the flow controller 212 includes a first flow control member 214 and a second flow control member 216. The first flow control member 214 is displaceable relative to the subterranean formation flow communicator 210. As well, the second flow control member 214 is displaceable relative to the subterranean formation flow communicator 210. In some embodiments, for example, both of the first flow control member 214 and the second flow control member 216 are in the form of sleeves that are slideably disposed within the passage 204.

Figure 7:
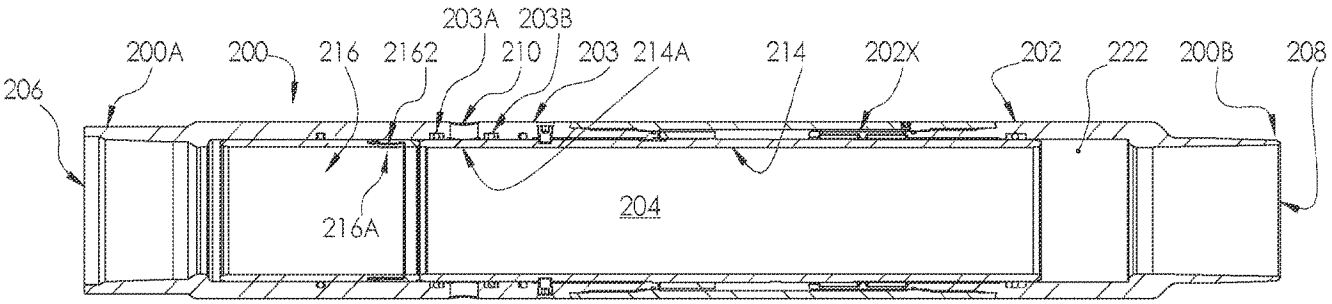
FIG. 7 is a sectional elevation view of another embodiment of a flow control apparatus, illustrating occlusion of the flow communicator by the first flow modulator of the first flow control member.

The first flow control member 214 includes a first flow modulator 214A for occluding the subterranean formation flow communicator 210, with effect that the subterranean formation flow communicator is disposed in an occluded condition. Referring to FIGS. 3 and 7, in some embodiments, for example, the first flow modulator 214A and the subterranean formation flow communicator 210 are co-operatively configured such that the occluding of the subterranean formation flow communicator 210 by the first flow modulator 214A is effected in response to alignment of the first flow modulator 214A with the subterranean formation flow communicator 210.

In some embodiments, for example, the occluding of the subterranean formation flow communicator 210 by the first flow modulator 214A is with effect that the subterranean formation flow communicator 210 is closed. In some embodiments, for example, the occluding of the subterranean formation flow communicator 210 by the first flow modulator 214A is with effect that the subterranean formation flow communicator 210 is covered by the flow controller 212. In some embodiments, for example, the occluding of the subterranean formation flow communicator 210 by the first flow modulator 214A is with effect that a sealed interface is defined. In some embodiments, for example, the sealed interface prevents, or substantially prevents, flow communication between the subterranean formation flow communicator 210 and the passage 204. In some embodiments, for example, the sealed interface is established by the disposition of the flow modulator 214A relative to the housing. In this respect, in some embodiments, for example, the sealed interface is established while the flow modulator 214A is disposed in a sealed, or substantially sealed, engagement relative to the housing 202. In some embodiments, for example, the sealed, or substantially sealed, engagement is effected by engagement of the flow modulator 214A to sealing members 203A, 203B that are retained relative to the housing 202.

The second flow control member 216 includes a second flow modulator 216A for effecting a reduction in pressure of material that is flowing from the housing passage 204 to the subterranean formation flow communicator 210. In some implementations, the reduction in pressure is effected to material that is being injected into the subterranean formation, such as, for example, to material that is being injected for effecting displacement of hydrocarbon material within a subterranean formation, such as, for example, during a waterflooding operation.

Figure 5:
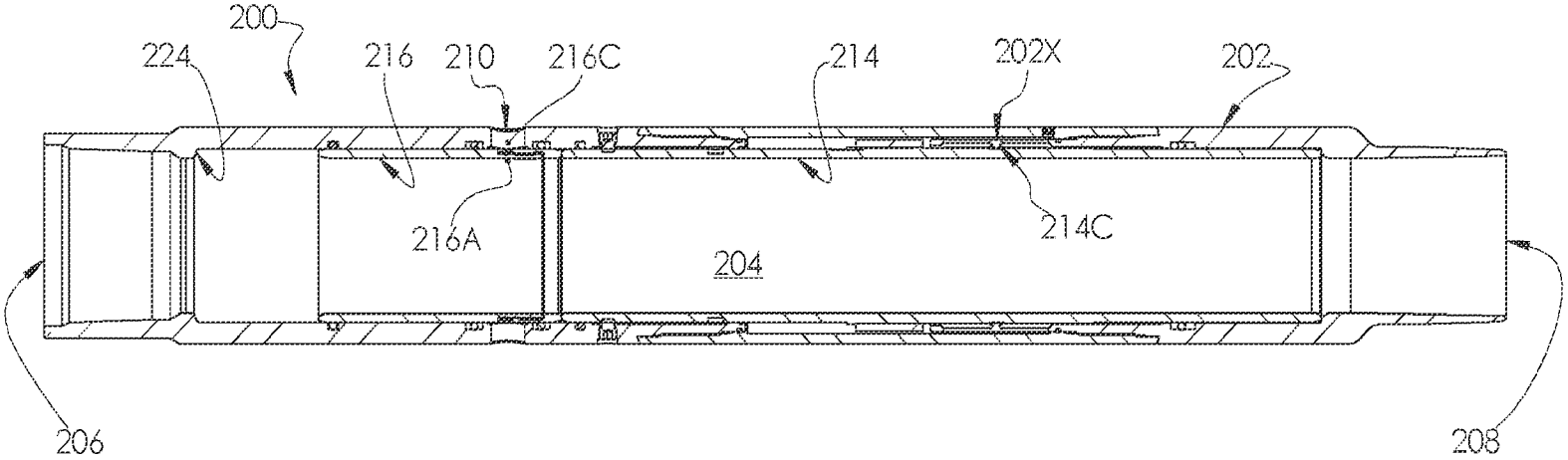
FIG. 5 is a sectional elevation view of the flow control apparatus of FIG. 2, illustrating the second flow control member having been displaced downhole such that the second flow modulator is aligned with the flow communicator.
Figure 9:
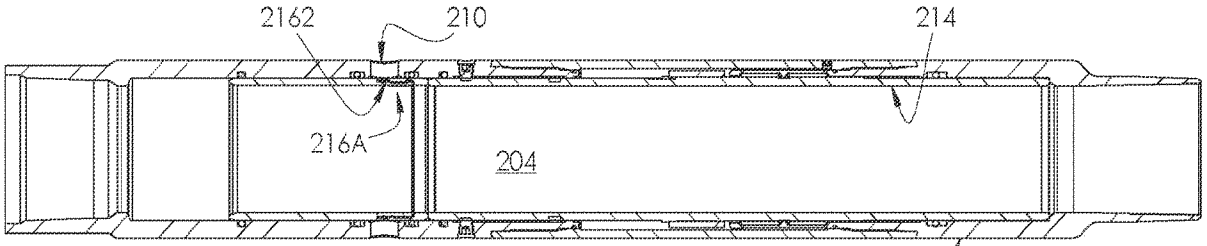
FIG. 9 is another sectional elevation view of the flow control apparatus of FIG. 7, illustrating the second flow control member having been displaced downhole such that the second flow modulator is aligned with the flow communicator.
Figure 10:
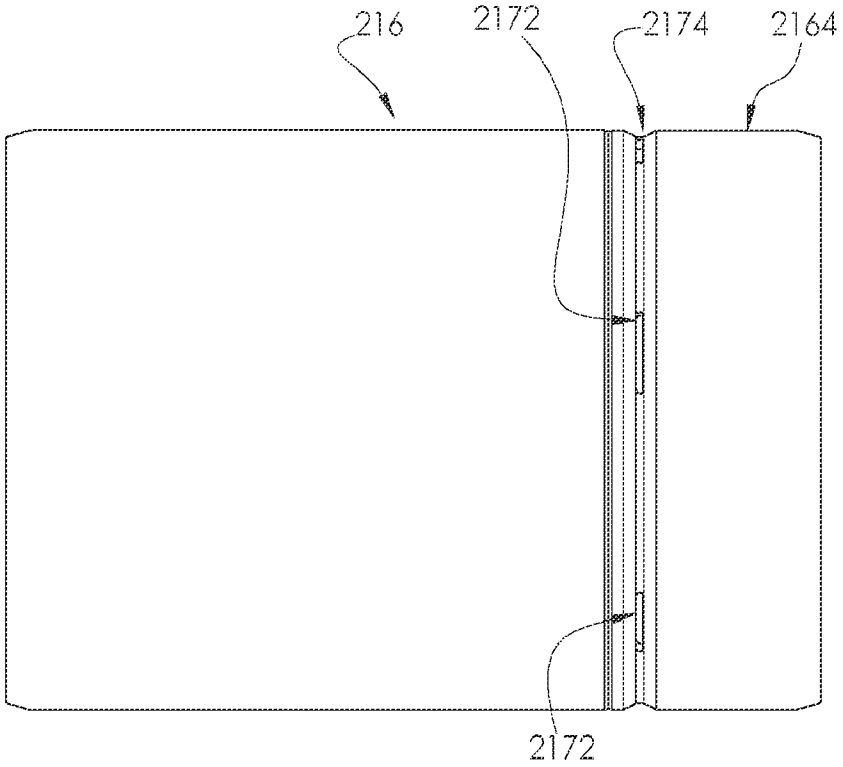
FIG. 10 is a front elevation view of the second flow control member of the flow control apparatus of FIG. 7.

Referring to FIGS. 5 and 9, in some embodiments, for example, the second flow modulator 216A and the subterranean formation flow communicator 210 are co-operatively configured such that, in response to alignment of the second flow modulator 216A with the subterranean formation flow communicator 210, an alignment-established flow communicator 215 is established that effects flow communication between the housing passage 204 and the subterranean formation flow communicator 210, and while the second flow modulator 216A is aligned with the subterranean formation flow communication 210, and material is flowing from the housing passage 204 to the subterranean formation flow communicator 210 via the established alignment-established flow communicator 215, the reduction in pressure of the material that is flowing from the housing passage 204 to the subterranean formation flow communicator 210, by the second flow modulator 216A, is effected.

Figure 4:
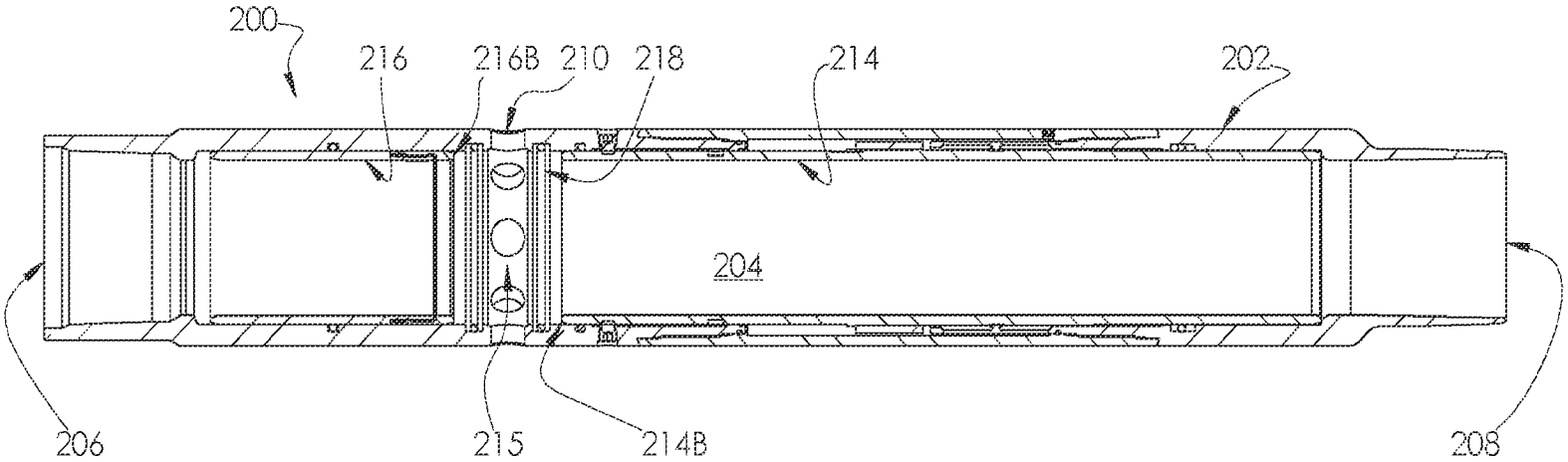
FIG. 4 is a sectional elevation view of the flow control apparatus of FIG. 2, illustrating the first flow control member having been displaced downhole such that the flow communicator is disposed in the non-occluded condition.
Figure 8:
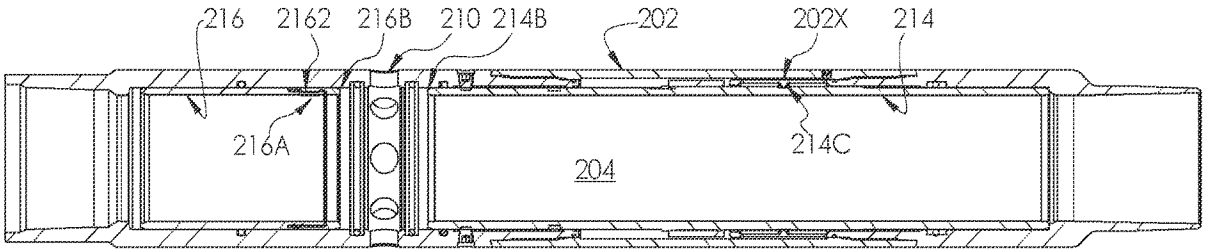
FIG. 8 is another sectional elevation view of the flow control apparatus of FIG. 7, illustrating the first flow control member having been displaced downhole such that the flow communicator is disposed in the non-occluded condition.

Referring to FIGS. 4 and 8, in some embodiments, for example, the first flow control member 214, the second flow control member 216, and the subterranean formation flow communicator 210 are co-operatively configured such that the first and second flow control members 214, 216 are positionable relative to the subterranean formation flow communicator 210 such that the subterranean formation flow communicator 210 is disposed in a non-occluded condition, wherein, while the subterranean formation flow communicator 210 is disposed in the non-occluded condition, there is an absence, or substantial absence, of occlusion of any portion of the subterranean formation flow communicator 210 by either one of, or both of, the first and second flow control members 214, 216.

In some embodiments, for example, while the subterranean formation flow communicator 210 is disposed in the non-occluded condition, flow communication between the housing passage 204 and the subterranean formation flow communicator 210 is effected via a non-occluded flow communicator 215 having a first resistance to material flow. The non-occluded flow communicator 215, that is established in response to the alignment of the second flow modulator 216A with the subterranean formation flow communicator 210, has a second material resistance to flow. The second resistance to material flow is greater than the first resistance to material flow by a multiple of at least 50, such as, for example, at least 100, such as, for example, at least 200.

In some embodiments, for example, the second flow modulator 216A includes a second flow modulator-defined flow communicator 216C configured for conducting a flow of material between the housing passage and the subterranean flow communicator. The conducting effects the reduction in pressure. The second flow modulator-defined flow communicator forms part of the alignment-established flow communicator that is established in response to the alignment of the second flow modulator 216A with the subterranean formation flow communicator 210.

Figure 6:
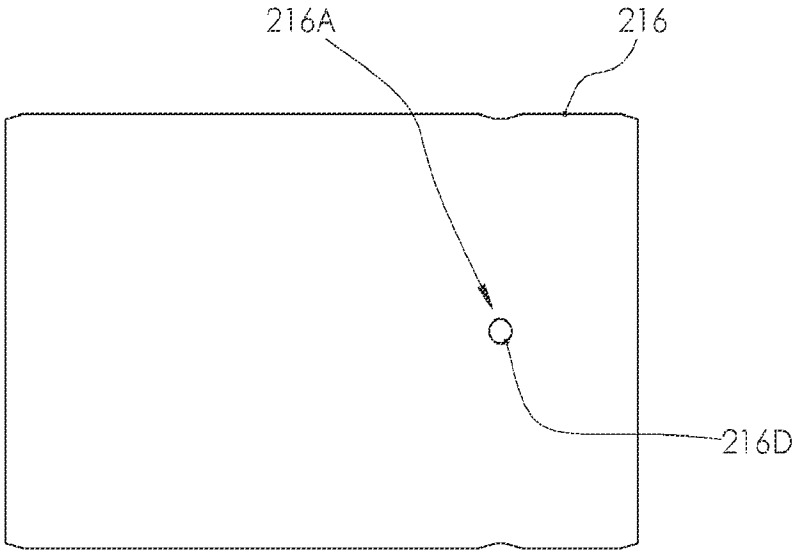
FIG. 6 is a schematic illustration of the second flow control member of the flow control apparatus illustrated in FIG. 2.

Referring to FIGS. 3 to 6, in some embodiments, for example, the second flow modulator-defined flow communicator includes one or more second flow modulator passages extending through the second flow control member 216. Each one of the one or more second flow modulator passages, independently, extends from a first side flow communicator 2168 (such as, for example, in the form of one or more ports), that extends through a first side 2170 of the second flow control member 216, to a second side flow communicator 2172 (such as, for example, in the form of one or more ports), that extends through a second side 2174 of the second flow control member 216, the second side 2174 being disposed on an opposite side of the flow control member 216 relative to the first side 2170. Each one of the one or more second flow modulator passages, independently, defines a respective orifice. The total cross-sectional flow area of the second flow modulator-defined flow communicator is less than the total cross-sectional flow area of the subterranean formation flow communicator 210. In some embodiments, for example, the ratio of the total cross-sectional flow area of the subterranean formation flow communicator 210 to the total cross-sectional flow area of the second flow modulator-defined flow communicator is at least about 25, such as, for example, at least about 50, such as, for example, at least about 100, such as, for example, at least about 200, such as, for example, at least about 250. Referring to FIG. 6, in some embodiments, for example, the second flow modulator-defined flow communicator 216C includes a total number of one passage (i.e. a single passage), and the single passage defines an orifice 216D, and the orifice has a cross-sectional flow area of between 0.5 square millimetres and 2.0 square millimetres.

Referring to FIGS. 7 to 14, in some embodiments, for example, for effecting a sufficient reduction in pressure of material that is being injected into the formation, the second flow modulator-defined flow communicator includes a tortuous flow path-defining fluid conductor 2162 that defines a tortuous flow path.

In some embodiments, for example, the ratio of the minimum cross-sectional flow area of the subterranean formation flow communicator 210 to the minimum cross-sectional flow area of the tortuous flow path-defining fluid conductor 2162 is at least about 700, such as, for example, at least about 1000, such as, for example, at least about 1500.

In some embodiments, for example, the tortuous flow path-defining fluid conductor 2162 has a plurality of approximately 90 degree bends. The total number of approximately 90 degree bends is at least about 25, such as, for example, at least about 50. In some embodiments, for example, the total number of approximately 90 degree bends is between about 25 and about 100.

In some embodiments, for example, the tortuous flow path-defining fluid conductor 2162 has a length, measured along the central longitudinal axis of the tortuous flow path-defining fluid conductor 2162, of at least about 250 millimetres. In some embodiments, for example, this length is between about 250 millimetres and about 900 millimetres.

In some embodiments, for example, the tortuous flow path-defining fluid conductor 2162 has a maximum cross-sectional flow area, and the maximum cross-sectional flow area is less than about 8.6 square millimeters (0.0131 square inches).

In some embodiments, for example, the tortuous flow path-defining fluid conductor 2162 has a minimum cross-sectional flow area, and the minimum cross-sectional flow area is at least about 5.0 square millimetres (0.0078 square inches).

In some embodiments, for example, the tortuous flow path-defining fluid conductor 2162 is a tortuous flow path-defining fluid conductor 2162 having a constant, or substantially constant, cross-sectional flow area, and a length, measured along the central longitudinal axis of the tortuous flow path-defining fluid conductor 2162, and the ratio of the length to the cross-sectional flow area is at least about 23 metres/square metre. In some of these embodiments, for example, the length of the tortuous flow path-defining fluid conductor 2162, measured along the central longitudinal axis of the tortuous flow path-defining fluid conductor 2162 is between about 250 millimetres and about 900 millimetres. In some of these embodiments, for example, the constant, or substantially constant, cross-sectional flow area of the tortuous flow path-defining fluid conductor 2162 is between about 5.0 square millimetres and about 8.6 square millimetres (between 0.0078 square inches and 0.0131 square inches).

Figure 11:
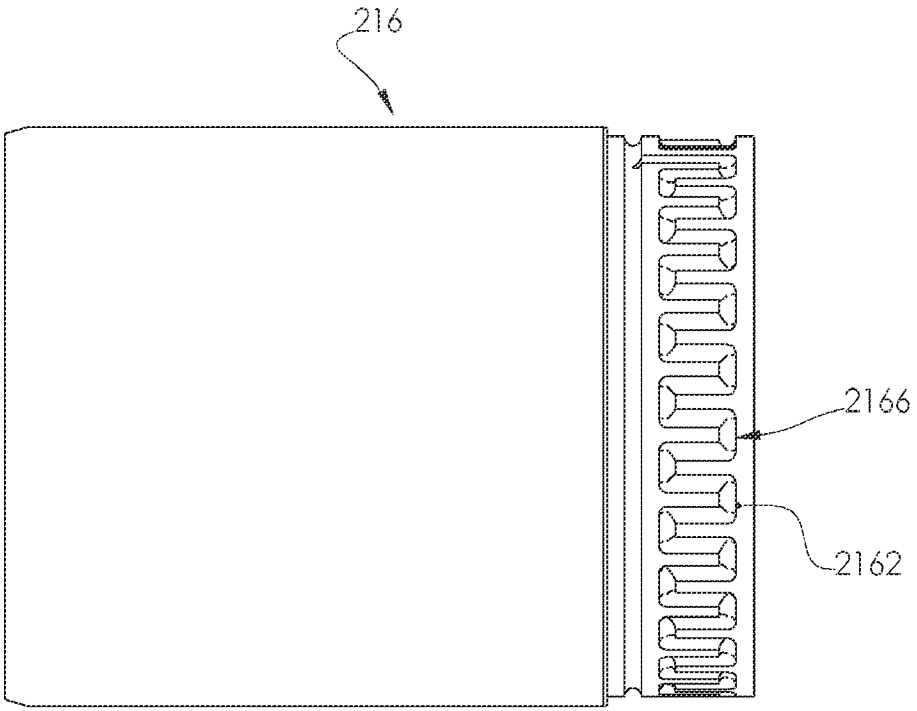
FIG. 11 is another front elevation view of the second flow control member of the flow control apparatus of FIG. 7, with a portion of the second flow control member removed to illustrate a channel of the tortuous flow path-defining fluid conductor.
Figure 12:
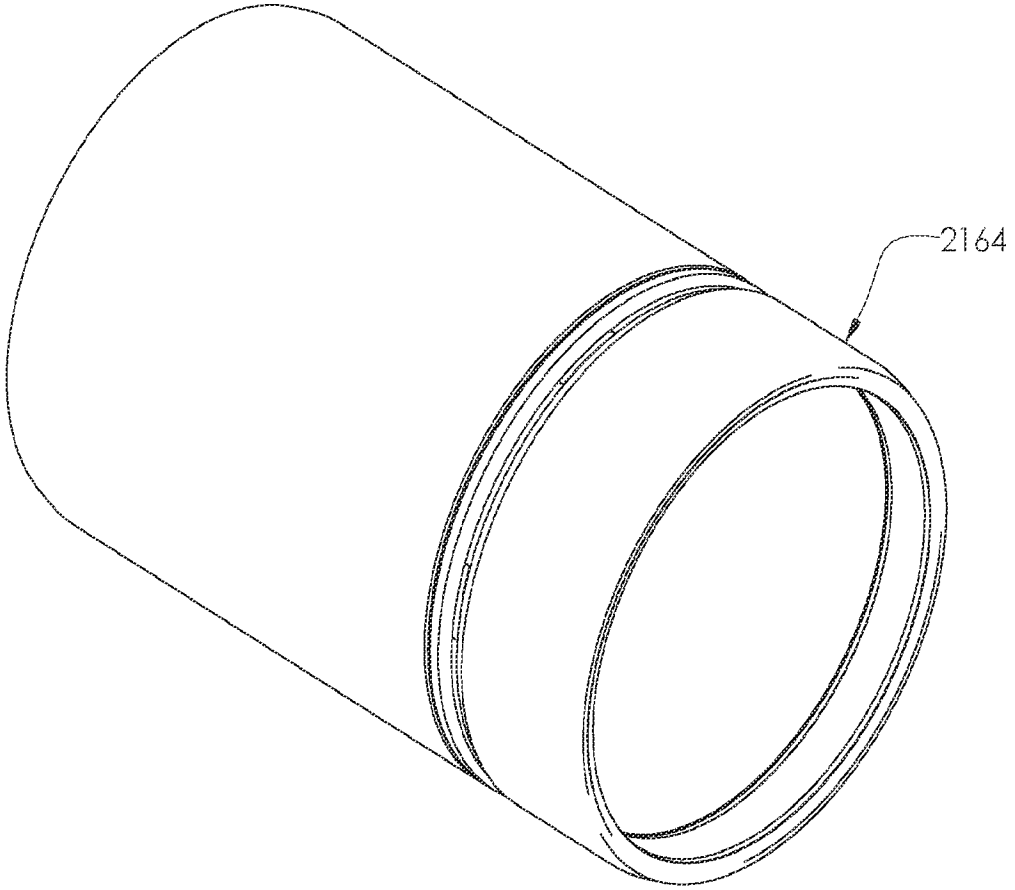
FIG. 12 is a top perspective view of the second flow control member of the flow control apparatus of FIG. 7.
Figure 13A:
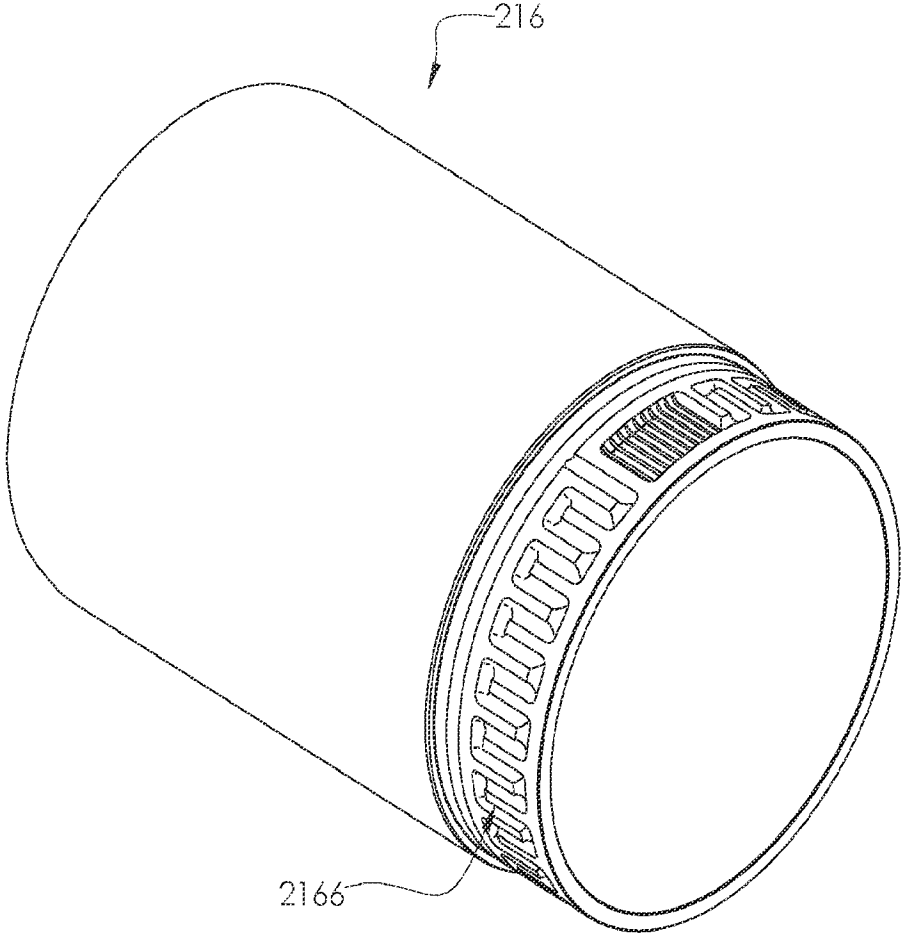
FIGS. 13A and 13B are another top perspective view of the second flow control member of the flow control apparatus of FIG. 7, with a portion of the second flow control member removed to illustrated a channel of the tortuous flow path-defining fluid conductor.
Figure 13B:
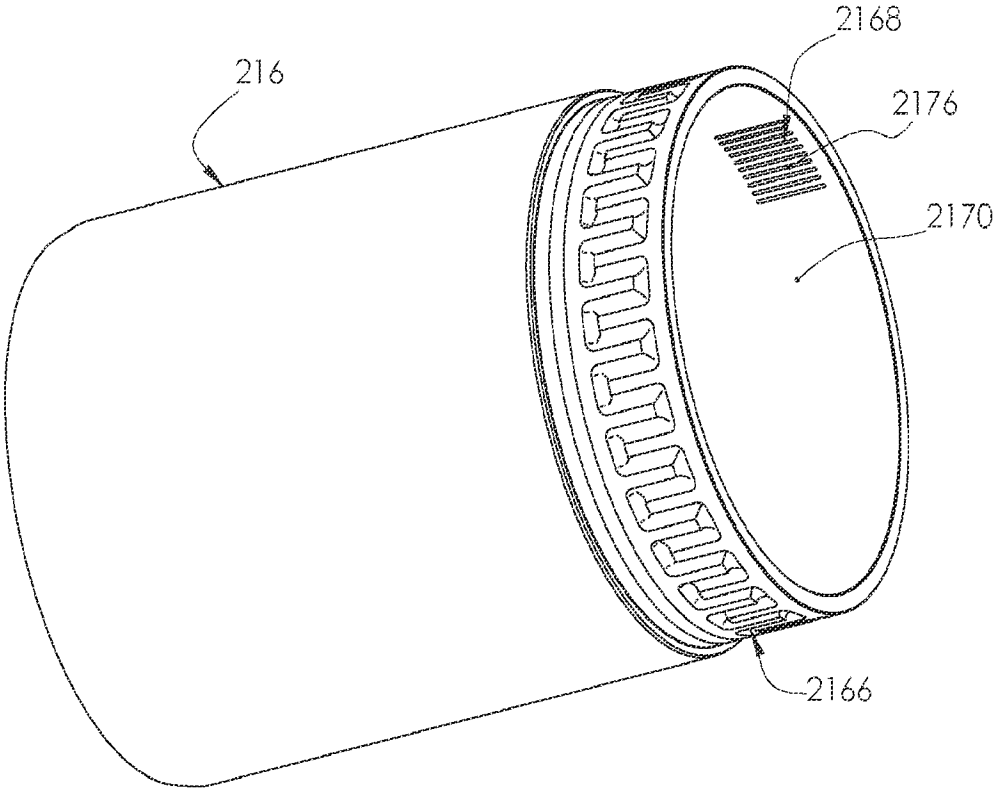
Figure 14:
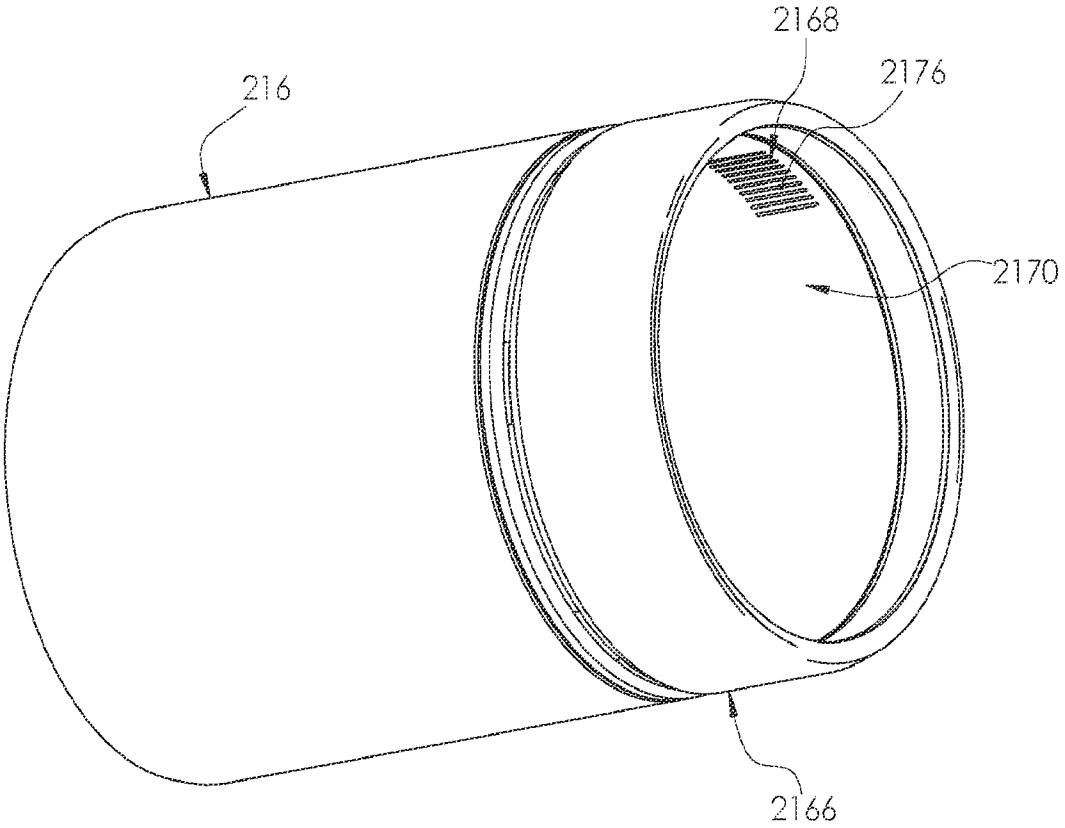
FIG. 14 is a bottom perspective view of the second flow control member of the flow control apparatus of FIG. 7, with a portion of the second flow control member removed to illustrate a channel of the tortuous flow path-defining fluid conductor.
Figure 15:
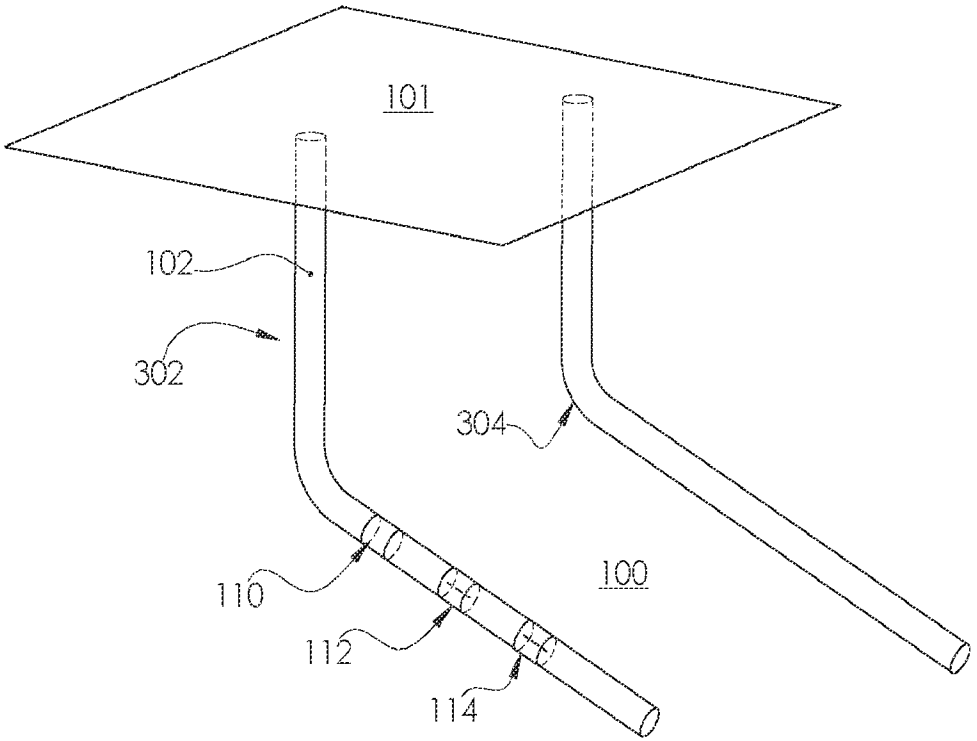
FIG. 15 is a schematic illustration of another system for effecting production of hydrocarbon material from a subterranean formation.

In some embodiments, for example, the second flow control member 216 defines a fluid compartment 2164, and the tortuous flow path-defining fluid conductor 2162 is defined within the compartment. Referring to FIGS. 11, 13, and 14, in some embodiments, for example, a fluid compartment-defined fluid conductor 2166 is defined within the fluid compartment 2164, and the fluid compartment-defined fluid conductor 2166 includes the tortuous flow path-defining fluid conductor 2162. In some of these embodiments, for example, a channel is milled into a surface of the second flow control member 216 that is disposed on an opposite side of the second flow control member 216 relative to an internal side surface that defines the passage 204, and a cap is integrated into the second flow control member 216, over the formed channel, in an interference fit to define the tortuous flow path-defining fluid conductor 2162.

In some embodiments, for example, flow communication between the fluid compartment-defined fluid compartment 2164 (and, therefore, the tortuous flow path-defining fluid conductor 2162) and the housing passage 204 is effected via a first side flow communicator 2168 (such as, for example, in the form of one or more ports) that extends through a first side 2170 of the second flow control member 216, and flow communication between the fluid compartment-defined fluid compartment 2164 (and, therefore, the tortuous path-defining fluid conductor) and the subterranean formation flow communicator 210 is effected via a second side flow communicator 2172 (such as, for example, in the form of one or more ports) that extends through a second side 2174 of the flow control member 216, the second side 2174 being disposed on an opposite side of the flow control member 216 relative to the first side 2170.

Referring to FIG. 4, in some embodiments, for example, the second flow control member 216 is configured for preventing, or substantially preventing, the second flow modulator-defined flow communicator from receiving oversize solid particulate matter from the housing passage 204. In some of these embodiments, for example, the oversize solid particulate matter, whose passage is prevented or substantially prevented, is +100 mesh proppant. This is to mitigate plugging of the second flow modulator-defined flow communicator.

In some embodiments, for example, the second flow modulator includes a filter medium 2176. In some embodiments, for example, the filter medium is disposed within the first side flow communicator for preventing, or substantially preventing, passage of the oversize solid particulate matter through the first side flow communicator and into the second flow modulator-defined flow communicator.

In some embodiments, for example, the filter medium is defined by slots formed within the housing by milling. In some embodiments, for example, the filter medium is defined by a screen (such as, for example, a sand screen). In some of these embodiments, for example, the screen is wrapped around a perforated section of a base pipe (such as, a base pipe that is defined by the second flow control member 216), the perforated section defining a plurality of apertures. In some embodiments, for example, the filter medium is in the form of a porous material that is integrated within an aperture of the second flow control member 216.

In some embodiments, for example, the first flow control member 214, the second flow control member 216, and the subterranean formation flow communicator are co-operatively configured such that (i) while the first flow modulator 214A is aligned with the subterranean formation flow communicator 210 (see FIGS. 3 and 7):

(a) the first flow modulator 214A is occluding the subterranean formation flow communicator 210 such that the subterranean formation flow communicator 210 is disposed in the occluded condition; and (b) the first flow control member 214 is displaceable relative to the subterranean formation flow communicator 210 such that a receiving space 218 is established for receiving the second flow control member 216;

(ii) while the receiving space 218 is established (see FIGS. 4 and 8), the second flow control member 216 is displaceable, relative to the subterranean formation flow communicator 210, for effecting alignment between the second flow modulator 216A and the subterranean formation flow communicator 210;

and (iii) while the second flow modulator 216A is aligned with the subterranean formation flow communicator 210 (see FIGS. 5 and 9), the second flow modulator 216A is disposed for effecting the reduction in pressure of the material that is flowing from the housing passage 204 to the subterranean formation flow communicator 210.

In some embodiments, for example, the first flow control member 214, the second flow control member 216, and the subterranean formation flow communicator 210 are co-operatively configured such that:

(i) while the second flow modulator 216A is aligned with the subterranean formation flow communicator 210 (see FIGS. 5 and 9):

(a) the second flow modulator 216A is disposed for effecting the reduction in pressure of material that is flowing between the housing passage 204 and the subterranean formation flow communicator 210; and (b) the second flow control member 216 is displaceable relative to the subterranean formation flow communicator 210 for establishing a receiving space 218 for receiving the first flow control member 214;

(ii) while the receiving space is established (see FIGS. 4 and 8), the first flow control member is displaceable relative to the subterranean formation flow communicator for effecting alignment between the first flow modulator 214A and the subterranean formation flow communicator 210; and (iii) while the first flow modulator 214A is aligned with the subterranean formation flow communicator 210 (see FIGS. 4 and 7), the first flow modulator 214A is occluding the subterranean formation flow communicator 210.

In some embodiments, for example, while the receiving space 218 is established, the subterranean formation flow communicator 210 is disposed in the non-occluded condition. In this respect, while there is an absence of alignment between the flow modulator 214A and the subterranean formation flow communicator 210, and there is an absence of alignment between the flow modulator 216A and the subterranean formation flow communicator 210, the subterranean formation flow communicator 210 is disposed in the non-occluded condition.

Referring to FIGS. 4 and 8, in some embodiments, for example, the first flow control member 214 and the second flow control member 216 are further co-operatively configured such that, after the displacement of the first flow control member 214 relative to the subterranean formation flow communicator 210, such that the receiving space 218 is established for receiving the second flow control member 216, the first flow control member 214 is spaced-apart relative to the second flow control member 216.

Referring to FIGS. 3 and 7, in some embodiments, for example, the flow control member 214 is said to be disposed in the closed position while the first flow modulator 214A is disposed in alignment with the subterranean formation flow communicator 210 (i.e. the subterranean formation flow communicator 210 is disposed in the occluded condition).

In some embodiments, for example, the displaceability of the first flow control member 214 relative to the subterranean formation flow communicator 210, such that a receiving space 218 is established for receiving the second flow control member 216 (see FIG. 6), in response to displacement of the second flow control member 216 relative to the subterranean formation flow communicator 210, such that the second flow modulator 216A becomes aligned with the subterranean formation flow communicator 210, is a displaceability in a downhole direction.

In some embodiments, for example, the first flow control member 214 is disposed downhole relative to the second flow control member 216, and the displacement of the first flow control member 214 relative to the subterranean formation flow communicator 210 is effected by urging the first flow control member 214 in a downhole direction. In other embodiments, for example, the first flow control member 214 is disposed uphole relative to the second flow control member 216, and requires a pulling-up force in order to establish the receiving space 218.

In some embodiments, for example, the flow control member 114 is disposed downhole relative to the second flow control member 116, and the first and second flow control members 214, 216 are co-operatively configured such that the first flow control member 214 defines a stop 214B for limiting downhole displacement of the second flow control member 216 relative to the first flow control member 214, and the second flow control member 116 defines a stop 216B for limiting uphole displacement of the first flow control member 114.

In this respect, and referring to FIGS. 3 and 7, in some embodiments, for example, the second flow control member 116 is positionable relative to the housing 202 such that displacement of the second flow control member 216, in an uphole direction, relative to the housing 202, is being prevented or substantially prevented, and the first flow control member 214, the second flow control member 216, and the subterranean formation flow communicator 210 are co-operatively configured such that, while the first flow control member 214 is disposed relative to the subterranean formation flow communicator 210 such that the first flow modulator 214A is aligned with the subterranean formation flow communicator 210:

(i) the second flow control member 216 is disposed, relative to the housing 202, such that displacement of the second flow control member 216, in an uphole direction, relative to the housing 202, is being prevented or substantially prevented;

and (ii) the first flow control member 216 is disposed in abutting engagement with the second flow control member 216 (i.e. the stop 216B);

such that an uphole displacement of the first flow control member 214, with effect that loss of the alignment between the first flow modulator 214A and the subterranean formation flow communicator 210 is effected, is prevented or substantially prevented. In this respect, while the second flow control member 216 is positioned, relative to the housing 202, such that displacement of the second flow control member 216, in an uphole direction, relative to the housing 202, is being prevented or substantially prevented, the alignment of the first flow modulator 214A with the flow communicator 210 is established when the first flow control member 214 is disposed in abutting engagement with the second flow control member 216 (i.e. the stop 216B). In this respect, and referring to FIGS. 4 and 8, while: (i) there is an absence of alignment between the flow modulator 214A and the subterranean formation flow communicator 210 (the flow modulator 214A is disposed downhole relative to the subterranean formation flow communicator 210, and (ii) the second flow control member 216 is positioned, relative to the housing, such that displacement of the second flow control member 216, in an uphole direction, relative to the housing 202, is being prevented or substantially prevented the alignment of the flow modulator 214A is establishable in response to urging of the first flow control member 214 (in the uphole direction), and, referring to FIGS. 3 and 7, the alignment is established and is, therefore, determinable, when the first flow control member 214 becomes disposed in abutting engagement with second flow control member 216 (i.e. the stop 216B). In some embodiments, for example, the positioning of the second flow control member 216, relative to the housing 202, such that displacement of the second flow control member 216, in an uphole direction, relative to the housing 202, is being prevented or substantially prevented, is effectible by disposition of the second flow control member 214 in an interference fit relative to the housing 202. While the second flow control member 216 is positioned, relative to the housing, such that displacement of the first flow control member 216, in an uphole direction, relative to the housing 202, is being prevented or substantially prevented, the alignment of the flow modulator 216A of the second flow control member 216 is establishable in response to urging of the second flow control member 216 in a downhole direction.

Referring to FIGS. 4 and 8, co-operatively, the first flow control member 214 is positionable relative to the housing 202 such that displacement of the first flow control member 214, in a downhole direction, relative to the housing 202, is being prevented or substantially prevented, and the first flow control member 214, the second flow control member 216, and the subterranean formation flow communicator 210 are co-operatively configured such that, while the second flow control member 216 is disposed relative to the subterranean formation flow communicator 210 such that the respective flow modulator 216A is aligned with the subterranean formation flow communicator 210:

(i) the first flow control member 214 is positioned, relative to the housing 202, such that displacement of the first flow control member 214, in a downhole direction, relative to the housing 202, is being prevented or substantially prevented;

and (ii) the second flow control member 216 is disposed in abutting engagement with the first flow control member 214 (i.e. the stop 214B);

such that downhole displacement of the second flow control member 216, with effect that loss of the alignment between the flow modulator 216A and the subterranean formation flow communicator 210 is effected, is prevented or substantially prevented. In this respect, while the first flow control member 214 is positioned, relative to the housing 202, such that displacement of the first flow control member 214, in a downhole direction, relative to the housing 202, is being prevented or substantially prevented, the alignment of the flow modulator 216A is established when the second flow control member 216 is disposed in abutting engagement with the first flow control member 214 (i.e. the stop 214B). In this respect, referring to FIGS. 4 and 8, while: (i) there is an absence of alignment between the flow modulator 216A and the subterranean formation flow communicator 210 (i.e. the flow modulator 216A is disposed uphole relative to the subterranean formation flow communicator 210), and (ii) the first flow control member 214 is positioned, relative to the housing 202, such that displacement of the first flow control member 214, in a downhole direction, relative to the housing 202, is being prevented or substantially prevented, the alignment of the flow modulator 216A is establishable in response to urging of the second flow control member 216 in the downhole direction, and, referring to FIGS. 5 and 9, the alignment is established and is, therefore, determinable, when the second flow control member 216 becomes disposed in abutting engagement with the first flow control member 214 (i.e. the stop 214A). In some embodiments, for example, the housing 202 includes a downhole-disposed stop 222, and the positioning of the first flow control member 214, relative to the housing, such that displacement of the first flow control member 214, in a downhole direction, relative to the housing 202, is being prevented or substantially prevented, is effectible by abutting engagement of the first flow control member 214 with the downhole-disposed stop 222. As well, in such embodiments, while the first flow control member 214 is positioned, relative to the housing 202, such that displacement of the first flow control member 214, in a downhole direction, relative to the housing 202, is being prevented or substantially prevented, the alignment of the flow modulator 214A of the first flow control member 214 is establishable in response to urging of the first flow control member 214 in an uphole direction.

In some embodiments, for example, while the flow control apparatus 200 is being run-in-hole, one of the flow control members 214, 216 (in the illustrated embodiment, this is the downhole-disposed one of the flow control members, i.e. the first flow control member 214) is releasably retained relative to the housing by one or more frangible members 203 (such as, for example, one or more shear pins). In some of these embodiments, for example, while releasably secured relative to the housing 202, the flow control member 214 is disposed such that the flow modulator 214A is aligned with the subterranean formation flow communicator 210. In some embodiments, for example, the other one of the flow control members 214, 216 (in the illustrated embodiment, this is the uphole-disposed one of the flow control members, i.e. the flow control member 216) is also releasably retained relative to the housing 202 by virtue of interference fit relative to the housing 202.

In such embodiments, both of: (i) release of the flow control member 214 from the releasable retention relative to the housing 202, and, upon such release, (ii) displacement of the flow control member 214 relative to the subterranean formation flow communicator 210, is effectible in response to urging of displacement of the flow control member 214, relative to the subterranean formation flow communicator 210, in a direction that is opposite to the direction in which the flow control member 216 is disposed relative to the flow control member 214 (in the illustrated embodiment, this is the downhole direction). In some embodiments, for example, a stop (in the illustrated embodiment, this is the downhole-disposed stop 222) is provided for limiting the displacement of the flow control member 214 such that, when the flow control member 214 becomes engaged to the stop 222, further displacement of the flow control member 214, remotely from the flow communicator 210 (in the illustrated embodiment, this is in the downhole direction), is prevented or substantially prevented. Co-operatively, this results in the flow communicator 210 becoming disposed in the non-occluded condition.

In some embodiments, for example, after the flow control member 214 has been released and displaced in a first direction (in the illustrated embodiment, this is the downhole direction) such that the flow control member 214 becomes engaged to the stop 222 (see FIGS. 4 and 8), displacement of the flow control member 214 can be urged in an opposite direction to that of the first direction (in the illustrated embodiment, this is the uphole direction) with effect that the flow control member 214 becomes disposed relative to the subterranean formation flow communicator 210 such that the flow modulator 214A becomes (in some embodiments, for example, once again) aligned with the subterranean formation flow communicator 210. In this respect, in some of these embodiments, for example, the flow control member 214, the flow control member 216, and the flow communicator 210 are co-operatively configured such that, while the flow control member 216 is disposed in an interference relationship relative to the housing 202, and referring to FIGS. 3 and 7, the alignment of the flow modulator 214A with the subterranean formation flow communicator 210 is determinable when the flow control member 214 becomes disposed in abutting engagement with the flow control member 216 (i.e. the stop 216B). In this respect, the alignment of the flow modulator 214A with the subterranean formation flow communicator 210 is established when the uphole-disposed flow control member 216 is disposed in abutting engagement with the downhole-disposed flow control member 216 (i.e. the stop 216B). In this respect, while the flow control member 216 is disposed in an interference fit relationship relative to the housing 202, when there is an absence of alignment between the flow modulator 214A and the subterranean formation flow communicator 210 (in the illustrated embodiment, this is when the flow modulator 214A is disposed downhole relative to the subterranean formation flow communicator 210), the flow control member 214 is displaceable, relative to the second flow control member 216, into abutting engagement with the flow control member 216 such that the flow modulator 214A becomes aligned with the subterranean formation flow communicator 210, in response to an urging of a displacement of the flow control member 214, relative to the subterranean formation flow communicator 210, in a direction in which the flow control member 216 is disposed (in the illustrated embodiment, this is the uphole direction).

When a stimulation operation (such as, for example, hydraulic fracturing) is being performed, release of the first flow control member 214 from retention relative to the housing 202 is effected by a force in a downhole direction (such as, for example, in response to fluid pressure that is translated via a shifting tool while the shifting tool is disposed in gripping engagement with the first flow control member 214). Once released, the first flow control member 214 is displaced relative to the subterranean formation flow communicator 210 in a first direction (in the illustrated embodiment, this is the downhole direction) such that the flow control member 214 becomes disposed in abutting engagement with the downhole-disposed stop 222 (see FIGS. 4 and 8), resulting in defeating occlusion of the subterranean formation flow communicator 210 by the first flow control member 214, with effect that the subterranean formation flow communicator 210 becomes disposed in the non-occluded condition (i.e. the subterranean formation flow communicator becomes "opened"). In some embodiments, for example, the housing 202 includes a collet retainer 202X for being releasably engaged to the first flow control member 214 while the flow control member is disposed in abutting engagement to the stop 222, and thereby releasably retaining the first flow control member 214 while the flow control member 214 is disposed in abutting engagement with the stop 222, and thereby preventing, or substantially preventing, inadvertent displacement of the flow control member 214 relative to the flow communicator 210 (for example, an inadvertent displacement which could cause obstruction of the flow communicator 210, and thereby interfere with a stimulation operation). Co-operatively, the first flow control member 214 includes a recessed portion 214C, and the recessed portion 214C and the collet retainer are co-operatively configured such that, in response to alignment of the recessed portion 214C with the collet retainer, the bias of the collet retainer 202X effects displacement of the collet retainer 202X, relative to the flow control member 214, such that the collet retainer 202X becomes disposed within the recessed portion 214C and functional for releasably retaining the first flow control member 214. To release the first flow control member 214 from the releasable retention by the collet retainer 202X, an uphole-directed force, sufficient to urge displacement of the collet retainer 202X from the recessed portion 214C, is applied to the first flow control member 214.

After the opening of the subterranean formation flow communicator 210, treatment material is injected from the surface and into the subterranean formation 100 via the wellbore 102 and the opened subterranean formation flow communicator 210 over a time interval of at least 20 minutes, such as, for example, at least one hour, such as, for example, at least 12 hours, such as, for example, at least 24 hours. After sufficient injecting, the first flow control member 214 is displaced in a direction opposite to the first direction (in the illustrated embodiment, this is the uphole direction) such that the first flow modulator 214A becomes aligned with the flow communicator 110, thereby occluding (such as, for example, closing) the subterranean formation flow communicator 210 (see FIGS. 3 and 7). This is so as to permit the injected stimulation material sufficient time to effect the desired stimulation and to permit the subterranean formation with sufficient time to heal. As discussed above, in some embodiments, for example, the second flow control member 216 is disposed in an interference fit relationship relative to the housing 202, and while the second flow control member 216 is disposed in an interference fit relationship relative to the housing 202, the alignment of the flow modulator 214A with the subterranean formation flow communicator 210 is determinable when the uphole-disposed flow control member 214 becomes disposed in abutting engagement with the downhole-disposed flow control member 216. In this respect, in such embodiments, the displacement of the flow control member 214 for occluding (such as, for example, closing) the subterranean formation flow communicator 210, is with effect that the flow modulator 214A becomes aligned with the subterranean formation flow communicator 210 when the flow control member 214 becomes disposed in abutting engagement to the flow control member 216. The displacement of the flow control member 214, relative to the housing 202, for effecting the occluding of the flow communicator 210, can be effected by applying a pulling up force to a shifting tool that is disposed in gripping engagement with the flow control member 214. In some embodiments, for example, after sufficient time has elapsed for effecting the desired stimulation and allowing the formation sufficient time to heal, the flow control member 214 is displaced, once again, relative to the subterranean formation flow communicator 210 (such as, for example, in the downhole direction, such as by fluid pressure applied to a shifting tool that is gripping the first flow control member 214), such that the subterranean formation flow communicator 210, once again, becomes disposed in the non-occluded condition, and production of hydrocarbon material from the subterranean formation 100 and into the wellbore 102, via the flow communicator 210, is effectible (see FIGS. 4 and 8). In some embodiments, for example, the producing of the hydrocarbon material, via the wellbore 102, is effected over a time interval of at least one (1) hour, such as, for example, at least two (2) hours, such as, for example, at least three (3) hours. Once production is completed, the flow control member 214 can be displaced, once again, such that the flow modulator 214A occludes the subterranean formation flow communicator 210 (see FIGS. 3 and 7).

In some embodiments, after having produced hydrocarbon material, as above-described, via the first well 302, reservoir pressure declines and production, via the first well 302, is no longer economical. In such case, it may become desirable to continue producing hydrocarbon material from the subterranean formation by way of a displacement process, such as waterflooding. To do so, the first well 302 can be converted to an injection well for injecting displacement fluid for displacing remaining hydrocarbon material to a second well 304. The apparatuses 200 within the first well 302 are configured for enabling such conversion. By manipulating the flow control members 114, 116 such that the second flow modulator 116A becomes disposed, relative to the subterranean formation flow communicator 210, for effecting the above-described pressure reduction of displacement fluid being flowed from the housing passage 202 to the subterranean formation flow communicator 210, such that the pressure of the displacement fluid being injected into the subterranean formation is suitably reduced for mitigating hydraulic fracturing of the subterranean formation during the displacement process.

To this end, the second flow control member 216 is displaced, relative to the housing 202, with effect that the second flow modulator 216A becomes disposed (such as, for example, disposed in alignment), relative to the flow communicator 210, for effecting the above-described pressure reduction (see FIGS. 5 and 9). In the illustrated embodiment, such displacement is in a downhole direction. In some embodiments, for example, such displacement is effectible with a shifting tool by actuating a bottomhole assembly including a shifting tool and a suitable sealing member (e.g. packer), such that the shifting tool becomes disposed in gripping engagement with the second flow control member 216 and a suitable sealed interface is established, and applying a fluid pressure differential across the sealed interface with effect that the resulting force, being applied in a downhole direction, is translated by the shifting tool to the flow control member 216, overcomes an opposing force, attributable to the interference fit relationship between the flow control member 216 and the housing 202, and effects displacement of the flow control member 216, relative to the housing 202, in a downhole direction. Because, initially, the first flow modulator 114A is disposed in alignment with the flow communicator 210 (see FIGS. 3 and 7), the force being applied to the second flow control member 116 becomes translated to the first flow control member 114 by virtue of the abutting engagement between the second flow control member 116 and the first flow control member 114, and thereby moving the first flow control member 114, in concert with the second flow control member 116, in a downhole direction. In doing so, the first flow modulator 114A is moved out of alignment with the subterranean formation flow communicator 210. Such movement continues until the first flow control member 114 bottoms out against the stop 222. Upon becoming disposed in abutting engagement to the stop 222, further downhole displacement of the first flow control member 114, relative to the housing 202, becomes prevented, or substantially prevented. Such engagement also establishes the limit for downhole displacement of the second flow control member 216 relative to the housing 202, as the first and second flow control members 214, 216 are co-operatively configured such that the first flow control member 114 defines a stop 214B for limiting downhole displacement of the second flow control member 216 relative to the first flow control member 214. Upon abutting engagement of the second flow control member 216 with the stop 214B, downhole displacement of the second flow control member 216, relative to the housing 202, is prevented or substantially prevented, and, co-operatively, the second flow modulator 216A becomes disposed in alignment with the subterranean formation flow communicator 210 for enabling injection of the displacement fluid through the subterranean flow communicator 210 for effecting the displacement process. In some embodiments, for example, the second flow control member 216 and the housing 202 are co-operatively configured such that, while the second flow modulator 216A is aligned with the flow communicator 210, the second flow control member 216 is disposed in an interference fit relationship with the housing 202. In some of these embodiments, for example, the interference fit relationship, between the second flow control member 216 and the housing 202 is maintained through the displacement of the second flow control member 216, relative to the flow communicator 210, from its initial position to the position assumed by the second flow control member 216 upon alignment of the second flow modulator 216A with the flow communicator 210. In this respect, after the second flow modulator 216A becomes disposed in alignment with the flow communicator 210, hydrocarbon material is produced from the subterranean formation using a displacement process, and the displacement process includes injecting displacement fluid into the subterranean formation via the second flow modulator 216A and the flow communicator 210, with effect that hydrocarbon material within the subterranean formation is displaced to the second well 304, and the displaced hydrocarbon material, that is received within the second well 304, is produced via the second well 302. In some embodiments, the hydrocarbon material is produced via the displacement process for a time interval of at least one (1) hour, such as, for example, at least two (2) hours, such as, for example, at least three (3) hours.

In some embodiments, for example, an exemplary shifting tool, for effecting the above-described displacements, is the SHIFT FRAC CLOSE™ tool available from NCS Multistage Inc.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A flow control apparatus configured for integration within a wellbore string disposed within a wellbore extending into a subterranean formation, comprising:

a housing, including a housing passage;

a subterranean formation flow communicator extending through the housing for effecting flow communication between the subterranean formation and the passage;

a first flow control member displaceable relative to the subterranean formation flow communicator; and a second flow control member displaceable relative to the subterranean formation flow communicator;

wherein:

the first flow control member includes a first flow modulator configured for occluding the subterranean formation flow communicator with effect that the subterranean formation flow communicator is disposed in an occluded condition;

the second flow control member includes a second flow modulator configured for effecting a modulation of flow characteristics of material that is flowing between the housing passage and the subterranean formation flow communicator; and the first and second flow control members are disposed adjacent to one another along the housing passage and are independently displaceable.

2. The flow control apparatus as claimed in claim 1, wherein the first flow control member, the second flow control member, and the subterranean formation flow communicator are co-operatively configured such that the first and second flow control members are positionable relative to the subterranean formation flow communicator such that the subterranean formation flow communicator is disposed in a non-occluded condition, wherein, while the subterranean formation flow communicator is disposed in the non-occluded condition, there is an absence, or substantial absence, of occlusion of any portion of the subterranean formation flow communicator by either one of, or both of, the first and second flow control members.

3. The flow control apparatus as claimed in claim 2, wherein the first flow control member, the second flow control member, and the subterranean formation flow communicator are co-operatively configured such that:

(i) while the subterranean formation flow communicator is disposed in the non-occluded condition, flow communication between the housing passage and the subterranean formation flow communicator is effected via a non-occluded flow communicator having a first resistance to material flow; and (ii) while the second flow modulator is disposed, relative to the subterranean formation flow communicator, for effecting the modulation of flow characteristics of material that is flowing between the housing passage and the subterranean formation flow communicator, flow communication between the housing passage and the subterranean formation flow communicator is effected via a second flow modulator-defined flow communicator having a second resistance to material flow; and the second resistance to material flow is greater than the first resistance to material flow.

4. The flow control apparatus as claimed in claim 3, wherein the second flow modulator includes a filter medium configured for preventing, or substantially preventing, passage of oversize material, from the housing passage and into the second flow modulator-defined flow communicator.

5. The flow control apparatus as claimed in claim 3, wherein the second flow modulator-defined flow communicator includes a tortuous flow path-defining fluid conductor that defines a tortuous flow path.

6. The flow control apparatus as claimed in claim 5, wherein the tortuous flow path-defining fluid conductor is a tortuous flow path-defining fluid conductor having a constant, or substantially constant, cross-sectional flow area, and a length, measured along a central longitudinal axis of the tortuous flow path-defining fluid conductor, and the ratio of the length to the cross-sectional flow area is at least about 23 metres/square metre.

7. The flow control apparatus as claimed in claim 1, wherein the first flow control member, the second flow control member, and the subterranean formation flow communicator are co-operatively configured such that:

(i) while the first flow modulator is occluding the subterranean formation flow communicator, the first flow control member is displaceable relative to the subterranean formation flow communicator for establishing a receiving space for receiving the second flow control member; and (ii) while the receiving space is established, the second flow control member is displaceable relative to the subterranean formation flow communicator for effecting disposition of the second flow modulator, relative to the subterranean formation flow communicator, for effecting the modulation of flow characteristics of material that is flowing between the housing passage and the subterranean formation flow communicator.

8. The flow control apparatus as claimed in claim 1 wherein the first flow control member, the second flow control member, and the subterranean formation flow communicator are co-operatively configured such that:

(i) while the second flow modulator is disposed, relative to the subterranean formation flow communicator, for effecting the modulation of flow characteristics of material that is flowing between the housing passage and the subterranean formation flow communicator, the second flow control member is displaceable relative to the subterranean formation flow communicator for establishing a receiving space for receiving the first flow control member; and (ii) while the receiving space is established, the first flow control member is displaceable relative to the subterranean formation flow communicator for effecting disposition of the first flow modulator, relative to the subterranean formation flow communicator, for occluding the subterranean formation flow communicator.

9. The flow control apparatus as claimed in claim 1, further comprising an uphole-disposed stop, wherein the position of the second flow control member, relative to the housing, such that displacement of the second flow control member, in an uphole direction, relative to the housing, is being prevented or substantially prevented, is established by engagement of the second flow control member with the uphole-disposed stop.

10. The flow control apparatus as claimed in claim 1, further comprising a downhole-disposed stop, wherein the position of the first flow control member, relative to the housing, such that displacement of the first flow control member, in a downhole direction, relative to the housing, is being prevented or substantially prevented, is established by engagement of the first flow control member with the downhole-disposed stop.

11. The flow control apparatus as claimed in claim 1 wherein the first flow control member is releasably secured relative to the housing with a frangible member such that the first flow modulator of the first flow control member is aligned with the subterranean formation flow communicator.

12. The flow control apparatus as claimed in claim 1, wherein the first flow control member has a first inner diameter, the second flow control member has a second inner diameter, and the first and second inner diameters are substantially equal.

13. The flow control apparatus as claimed in claim 12, wherein the first inner diameter is constant along an entire length of the first flow control member and the second inner diameter is constant along an entire length of the second flow control member.

14. A flow control apparatus configured for integration within a wellbore string disposed within a wellbore extending into a subterranean formation, comprising:

a housing includes a housing passage;

a subterranean formation flow communicator extending through the housing for effecting flow communication between the subterranean formation and the passage; and a flow controller comprising first and second flow controller members and configured for controlling conducting of material, via the subterranean formation flow communicator, between the passage and an environment external to the flow control apparatus;

wherein:

the flow controller is configured for disposition in at least first, second and third conditions;

the flow controller and the subterranean formation flow communicator are co-operatively configured such that:

while the flow controller is disposed in the first condition, the first flow controller member is positioned opposite the subterranean formation flow communicator and thereby occludes the subterranean formation flow communicator such that the subterranean formation flow communicator is disposed in an occluded condition;

while the flow controller is disposed in the second condition, the first and second flow controller members are spaced from the subterranean formation flow communicator along the housing passage and thereby dispose the subterranean formation flow communicator in a non-occluded condition; and while the flow controller is disposed in the third condition, flow communication between the housing passage and the subterranean formation flow communicator is effected via the second flow controller member, the second flow controller member having a third condition-defined flow communicator, the third condition-defined flow communicator including a flow controller-defined flow conductor; and the first and second flow controller members are disposed adjacent to one another along the housing passage.

15. The flow control apparatus as claimed in claim 14, wherein at least a portion of the flow controller-defined fluid conductor is a tortuous flow path-defining fluid conductor that defines a tortuous flow path.

16. The flow control apparatus as claimed in claim 14, wherein the flow controller-defined fluid conductor includes a filter medium configured for preventing, or substantially preventing, passage of oversize material from the housing passage.

17. The flow control apparatus as claimed in claim 14, wherein, while the flow controller is disposed in the second condition, flow communication between the housing passage and the subterranean formation flow communicator is effected via a second condition-defined flow communicator having a first resistance to material flow;

the third condition-defined flow communicator has a second resistance to material flow; and the second resistance to material flow is greater than the first resistance to material flow.

18. The flow control apparatus as claimed in claim 14, wherein the first flow controller member has a first inner diameter, the second flow controller member has a second inner diameter, and the first and second inner diameter are substantially equal.

19. The flow control apparatus as claimed in claim 18, wherein the first inner diameter is constant along an entire length of the first flow controller member and the second inner diameter is constant along an entire length of the second flow controller member.

20. A process for producing hydrocarbon material from a subterranean formation, comprising:

receiving hydrocarbon material within a first well from the subterranean formation via a subterranean formation flow communicator while a flow modulator, comprising first and second flow members, is disposed within the first well away from the subterranean formation flow communicator, and producing the received hydrocarbon material via the first well;

after the producing of the hydrocarbon material via the first well, effecting disposition of the first flow member of the flow modulator relative to the subterranean formation flow communicator for effecting a modulation of flow characteristics of material that is flowing within the first well, wherein the first flow member of the flow modulator includes a flow modulator-defined flow conductor and is laterally adjacent to the second flow member along the first well;

injecting displacement material into the subterranean formation via the subterranean formation flow communicator while the first flow member of the flow modulator is disposed relative to the subterranean formation flow communicator for effecting the modulation of flow characteristics of material that is flowing within the first well, with effect that hydrocarbon material within the subterranean formation is displaced to a second well, wherein the injecting includes flowing the displacement material within the second well through the flow modulator-defined flow conductor; and producing the hydrocarbon material that is received by the second well.

21. The process as claimed in claim 20, further comprising:

prior to the receiving of hydrocarbon material via the first well, stimulating the subterranean formation for production, wherein the stimulating includes injecting treatment material into the subterranean formation via the subterranean formation flow communicator.

22. The process as claimed in claim 21, wherein the stimulating includes hydraulically fracturing of the subterranean formation.

23. The process as claimed in claim 20, further comprising:

prior to the receiving hydrocarbon material and producing via the first well, defeating occlusion of an occluded subterranean formation flow communicator by the second flow member of the flow modulator, such that the subterranean formation flow communicator becomes disposed in a first opened condition;

while the subterranean formation flow communicator is disposed in the first opened condition, injecting treatment material into the subterranean formation via the subterranean formation flow communicator such that the subterranean formation is stimulated; and after the injecting of the treatment material, occluding the subterranean formation flow communicator by the second flow member for a first time interval.

24. The process as claimed in claim 20, wherein the flow modulator-defined flow conductor of the first flow member includes a tortuous flow path-defining fluid conductor that defines a tortuous flow path.

* * * * *